US005960622A

United States Patent [19]

Koch et al.

[11] Patent Number: 5,960,622

[45] Date of Patent: Oct. 5, 1999

[54] CABLE DEPOSITING DEVICE

[75] Inventors: Max Koch, Meggen; Alois Lustenberger, Littau; Roberto Gasperi, Ebikon, all of Switzerland

[73] Assignee: Komax Holding AG, Switzerland

[21] Appl. No.: 08/791,858

[22] Filed: Jan. 29, 1997

[30] Foreign Application Priority Data

Jan. 30, 1996 [SE] Sweden ..... 00232/96
Aug. 23, 1996 [SE] Sweden ..... 2068/96

[51] Int. Cl.[6] ..... D01H 9/10
[52] U.S. Cl. ..... 57/281; 57/90; 198/433
[58] Field of Search ..... 57/281, 90; 198/433

[56] References Cited

U.S. PATENT DOCUMENTS 3,010,275 11/1961 Hartmann et al. ..... 57/13
5,168,696 12/1992 Stahlecker ..... 57/90
5,501,314 3/1996 Tomat et al. ..... 198/433

*Primary Examiner*—William Stryjewski
*Attorney, Agent, or Firm*—Jeffer, Mangels, Butler & Marmaro LLP

[57] ABSTRACT

A cable depositing device for processing a plurality of cables includes at least one receiving transport band having a length and an entry end, a partition that extends above the upper driving strand of the receiving transport band along the length of the receiving transport band, and a swivel arm. The receiving transport band defines a cable entry region and includes an upper driving strand. The upper driving strand and the partition define two receiving and stretching regions on either side of the partition. The swivel arm is disposed in the cable entry region, defines a swivelling-out range and includes a cable gripper.

33 Claims, 9 Drawing Sheets

CABLE DEPOSITING DEVICE

FIELD OF THE INVENTION

The invention relates to a cable depositing device for automatic cable processing machines for simultaneous separate deposition of two individual trimmed and stretched cables or two trimmed and stretched cables joined at one of their ends to form a double cable on at least one receiving transport band and for separating these cables after their processing, and also to an extension piece for this cable depositing device.

DESCRIPTION OF THE RELATED ART

It is known to use automatic cable processing machines to produce double crimp cables in which two cables of possibly different cross-section and different length are joined to one another at one of their ends by means of a single crimp contact, and are likewise joined at their other ends with one crimp contact each. Particularly in the case of larger cable lengths, the risk of mutual entanglement of the two cable sections joined to one another in such a way increases abruptly and requires, in particular in the case of large cable lengths, immediate removal and spatial severance of the two free cable sections by hand, as well as appropriate deposition.

Processing two different cables of relatively large length simultaneously in parallel with one another in a single automatic cable processing machine has not been disclosed, because of the risk of mutual entanglement of such different cables.

SUMMARY OF THE INVENTION

The object of the present invention is to provide a cable depositing device of the type mentioned of the precious device, set forth above, that is to say by means of which it is possible, even if they are joined to one another at one of their ends via a double crimp contact, for two cables being processed in parallel with one another to be separated spatially from one another at least approximately over their entire length and deposited stretched in two cable deposition troughs running parallel to one another, and to be separately tied off.

In accordance with one aspect of the present invention, there is provided a cable depositing device for automatic cable processing machines for simultaneous separate deposition of two individual trimmed and stretched cables or two trimmed and stretched cables joined at one of their ends to form a double cable on at least one receiving transport band, and for separating these cables after their processing. The device is characterized in that for the purpose of forming two mutually separated receiving and stretching regions arranged on both sides, there is provided, between the two ejection movement axes of the cables conveyed out of the automatic cable processing machine, a partition which extends along the two receiving and stretching regions, and the two receiving and stretching regions are formed by at least one upper driving strand of an endlessly circulating transport band. Furthermore, there is provided in the cable entry region of the latter a swivel arm intended for gripping the rear ends, seen in their transport direction, of the two cables, which is provided with cable gripping parts, for feeding the rear ends, to be processed, of the two cables to at least one cable processing station located in the swivelling-out range of the swivel arm. In the case in which the swivelling range of the swivel arm does not extend beyond the two ejection movement axes, there is arranged at the entry end of the receiving and stretching region, beyond which the swivelling out range of the swivel arm does not project, a cable ejecting arrangement which can be moved laterally outwards beyond the said receiving and stretching region, and one cable deposition trough each is provided below the two cable ejection longitudinal sides of the two receiving and stretching regions separate from one another by means of the partition, and in a fashion extending over the entire length of the said receiving and stretching regions.

In accordance with another aspect of the present invention, there is provided a cable depositing device for automatic cable processing machines which have in their cable exit region a swivel arm, intended for gripping the rear ends, seen in their transport direction, of two cables to be processed, and provided with cable gripping parts, for feeding the rear ends, to be processed, of the two cables to at least one cable processing station located in the swivelling-out range of the swivel arm. The device is characterized in that, for simultaneous separate deposition of two individual trimmed and stretched cables or two trimmed and stretched cables joined at one of their ends to form a double cable on at least one receiving transport band, and for separating these cables after their processing, for the purpose of forming two mutually separated receiving and stretching regions arranged on both sides, there is provided, between the two ejection movement axes of the cables conveyed out of the automatic cable processing machine, a partition which extends along the two receiving and stretching regions, and the two receiving and stretching regions are formed by at least one upper driving strand of an endlessly circulating transport band. Furthermore, in the case in which the swivelling range of the swivel arm does not extend beyond the two ejection movement axes, there is arranged at the entry end of the receiving and stretching region, beyond which the swivelling out range of the swivel arm does not project, a cable ejecting arrangement which can be moved laterally outwards beyond the said receiving and stretching region, and one cable deposition trough each is provided below the two cable ejection longitudinal sides of the two receiving and stretching regions separate from one another by means of the partition, and in a fashion extending over the entire length of the said receiving and stretching regions.

BRIEF DESCRIPTION OF THE DRAWINGS

The invention may be more readily understood by referring to the accompanying drawings in which.

In all the figures, those parts which are similar to one another are provided with the same reference numerals, with the result that there is no need for a repeated description of the parts which are similar to one another.

DESCRIPTION OF THE PREFERRED EMBODIMENTS

Figure 1:
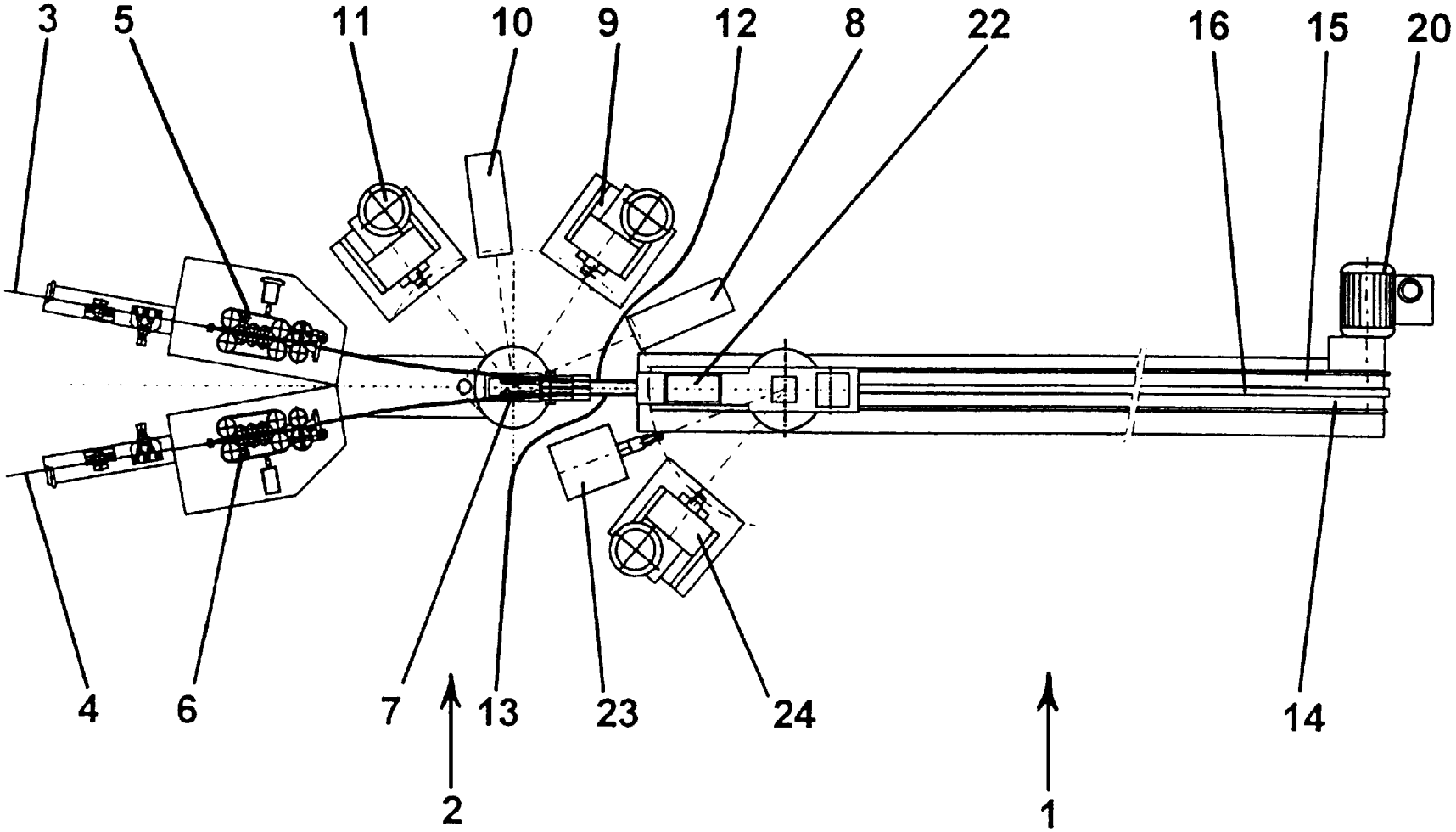
FIG. 1 is a schematic plan view showing a first embodiment of a cable depositing device according to the present invention in combination with a known automatic cable processing machine.

As is to be seen, in particular, from FIG. 1, the cable depositing device 1 according to the invention is connected to a conventional, previously known, automatic cable processing machine 2 to form a common machining unit, and is used for the separated deposition of cables 3 and 4, processed by the automatic cable processing machine 2, in order to produce so-called double crimp cables.

The two cables 3 and 4 are fed in a known way by means of the two band drive units 5 and 6 to a swivel head 7, which feeds the front ends of the cables 3, 4 to one or more of the processing stations 8 to 11 for them to be bared and subsequently have a crimp contact pressed on.

After this processing of the front ends of the two cables 3, 4, they are ejected at high speed along the two ejection movement axes 12,13 (see FIGS. 1 and 4) into the cable depositing device 1.

For the purpose of forming two mutually separated receiving and stretching regions 14 and 15 arranged on both sides, there is provided between the two ejection movement axes 12,13 of the cables 3,4 conveyed out of the automatic cable processing machine 2 a vertical partition 16 which extends along and in between the two receiving and stretching regions. The two receiving and stretching regions 14 and 15 are formed in this case by an upper driving strand extending below the partition 16 in the horizontal direction on both sides of the partition 16, of an endlessly circulating receiving transport band 17. The latter is guided over the two deflecting rollers 18 and 19 and is driven by means of a drive motor 20. The drive motor 20 is connected to the deflecting roller 19 in such a way that the circulating speed of the receiving transport band 17 is greater than the ejection rate of the two cables 3 and 4 that are emerging from the automatic cable processing machine 2, in order to achieve a stretched reception of the two cables 3 and 4 on the two receiving and stretching regions 14 and 15 separated longitudinally from one another.

There is provided in the cable entry region of the receiving transport band 17 a swivel arm 22, intended for gripping the rear ends, seen in their transport direction, of the two cables 3, 4. The swivel arm 22 is provided with a double gripper 21, for feeding the two cables 3, 4 to an intermediate unit 23 located in the swivelling-out range of the swivel arm 22, where the two bared cable ends are combined, and then to a double crimping unit 24, where the two ends are joined by means of a common crimp contact 25. The swivel arm 22 provided with the double gripper 21 can in this case constitute a part of the automatic cable processing machine 2 or a part of the cable depositing device 1.

In this arrangement, the positioning motor 26 is used for accurately controlled swivelling of the swivel arm 22, and the positioning motor 27 is used for longitudinal displacement of the latter.

One cable deposition trough 30 and 31, respectively, each is provided for depositing the completely processed cables 3' and 4', respectively, beneath the two cable ejection longitudinal sides 28 and 29 of the two receiving and stretching regions 14 and 15, mutually separated by means of the partition 16, and extending over their entire length.

Figure 4:
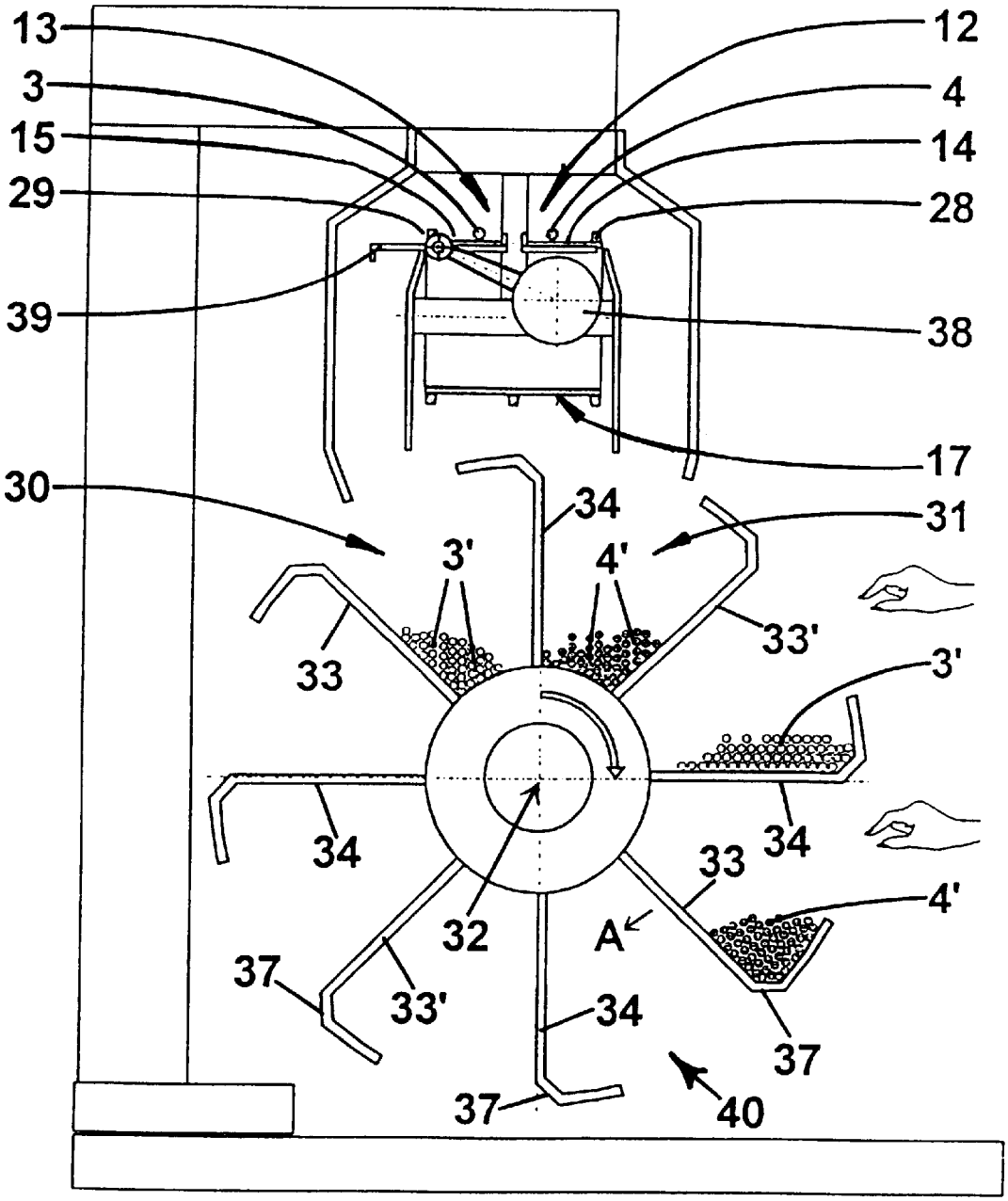
FIG. 4 is an enlarged scale, an end view of the entry end of the depositing device shown in FIGS. 1 to 3.

As is to be seen, in particular, from FIG. 4, in order to be able, after production of the desired batch quantity, to tie off the two separated, subdivided strands 3' and 4' in a fashion separate from one another in the respective cable deposition troughs 30 and 31 without interrupting the deposition, and thereafter to be able to take the entire tied off cable assembly, from the two deposition troughs 30 and 31, four pairs 30, 31 of cable deposition troughs are provided. They are arranged in a manner resembling a paddle wheel, in a fashion capable of rotating, in steps, about a rotation axis 32 that extends parallel to the two receiving and stretching regions 14, 15 for each step, a pair of troughs 30, 31 rotates in an angular range of 90°.

In this arrangement, a pair 30, 31 of troughs in each case has three boundary walls 33, 33' and 34 extending in radial planes and along the rotation axis 32, it being the case that the respective middle boundary wall 34 forms between two neighbouring cable deposition troughs 30,31 of a pair 30,31 of troughs a partition whose front edge 35, at the entry end, is set back with respect to the two front edges 36,36', at the entry end, for the two outer boundary walls 33,33' of the pair 30,31 of the troughs.

In order to be able to take a tied-off double crimp cable strand 3',4' out of a pair 30,31 of cable troughs without hindrance, the front edges 35, at the entry end, of the partitions 34 additionally run radially outwards in a bevelled fashion to the rear.

In order to be able to receive the completely processed double crimp cables 3',4' over their entire length in the double troughs 30,31 formed in this way the front edges 36,36', at the entry end, of the respective two outer boundary walls, seen in the plan view of the device and in the direction of movement of the cables 3,4 conveyed out of automatic cable machine 2, are located upstream of the delivery point of the double gripper 21 provided on the swivel arm 22.

In order to prevent the finished cables 3',4' from falling out of the double troughs 30,31, when the arrangement, of the double troughs 30,31 is rotated from the receiving position into the removing position by an angle of rotation of 90°, along their outer side 37 running parallel to their rotation axis 32, the boundary walls 33,33' and 34 of the cable deposition troughs 30,31 are bent off rearwards in a direction opposed to the direction A of rotation of the rotation axis 32.

The result of this arrangement of the two cable deposition troughs 30 and 31, which are to be charged, below the ejection longitudinal sides 29 and 28, respectively, is that in the case of the swivelling-out movement of the swivel arm 22 towards the double crimping unit 24 the cable section, of the cable 4 thereby deflected is moved out laterally in the deflection direction beyond the ejection longitudinal side 28 of the receiving transport band 17. As a result ejection of the cable 4 into the deposition trough 31 located thereunder is effected together with the circulating movement of the transport band 17.

Figure 2:
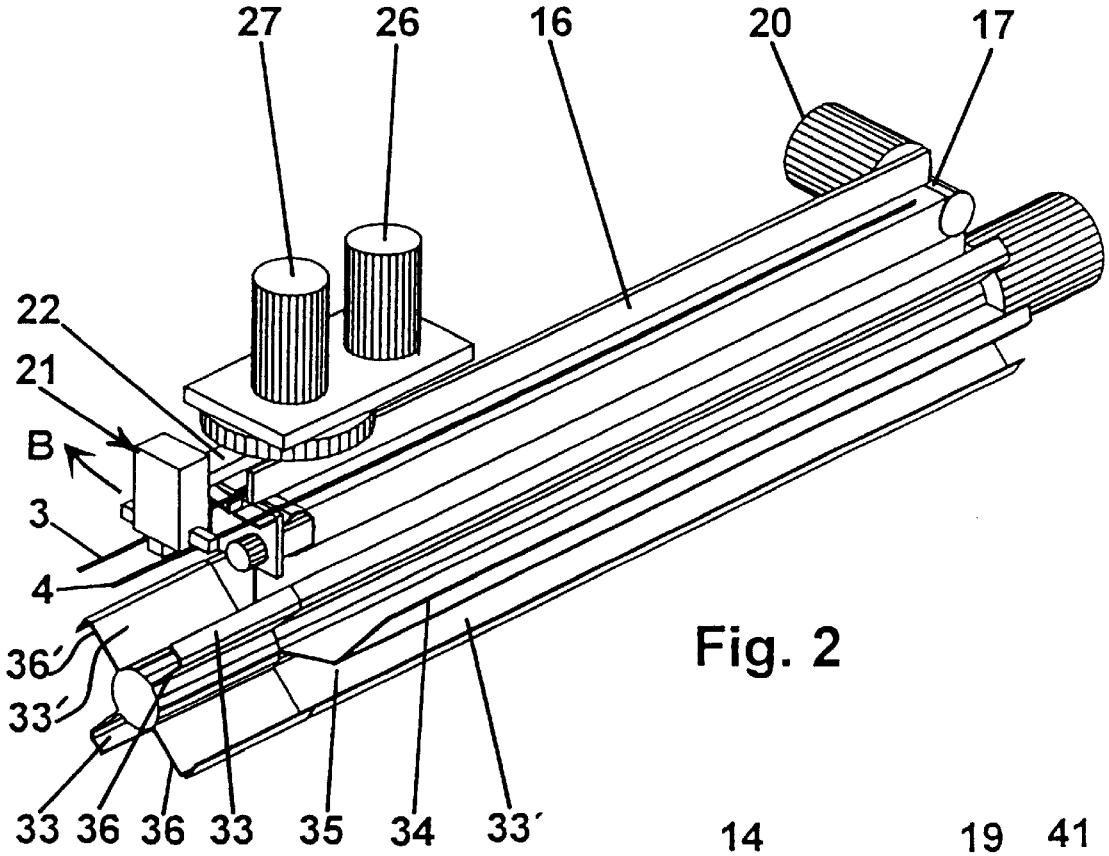
FIG. 2 is a perspective view of the cable depositing device of FIG. 1.
Figure 3:
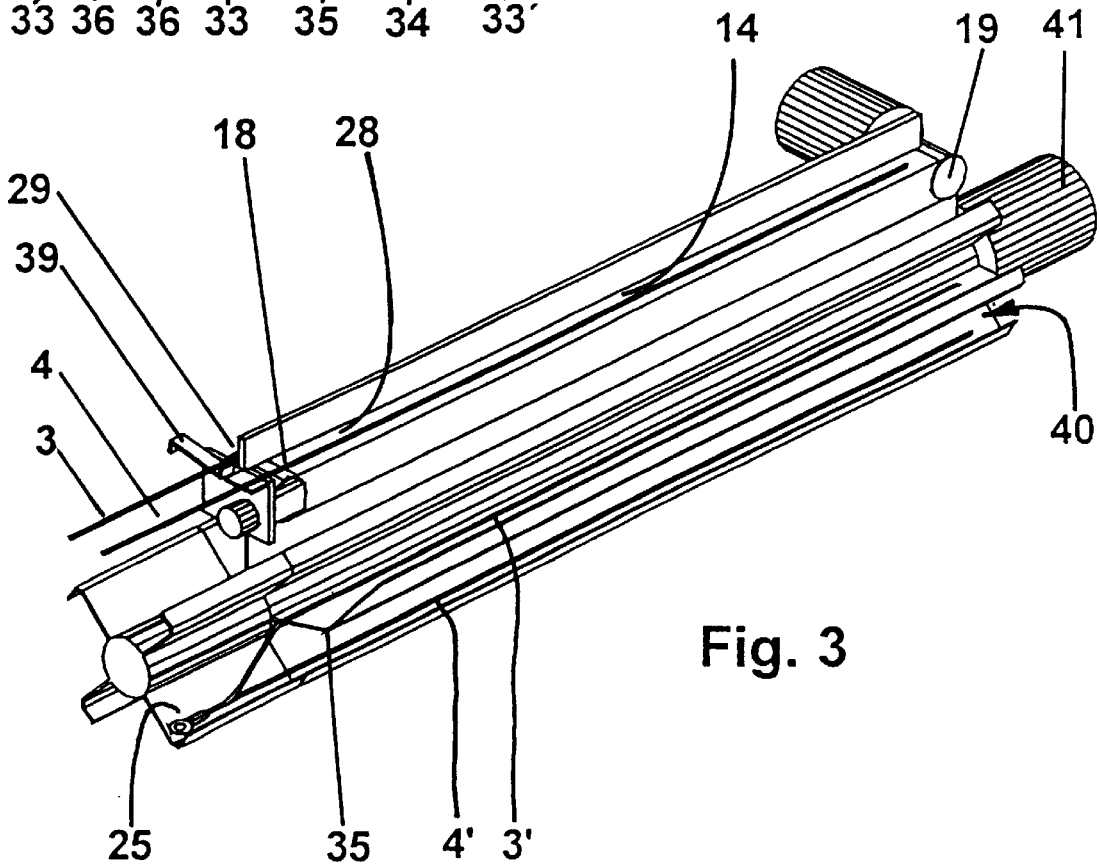
FIG. 3 is a perspective view similar to FIG. 2, but with a depositing star rotated by one step.
Figure 7:
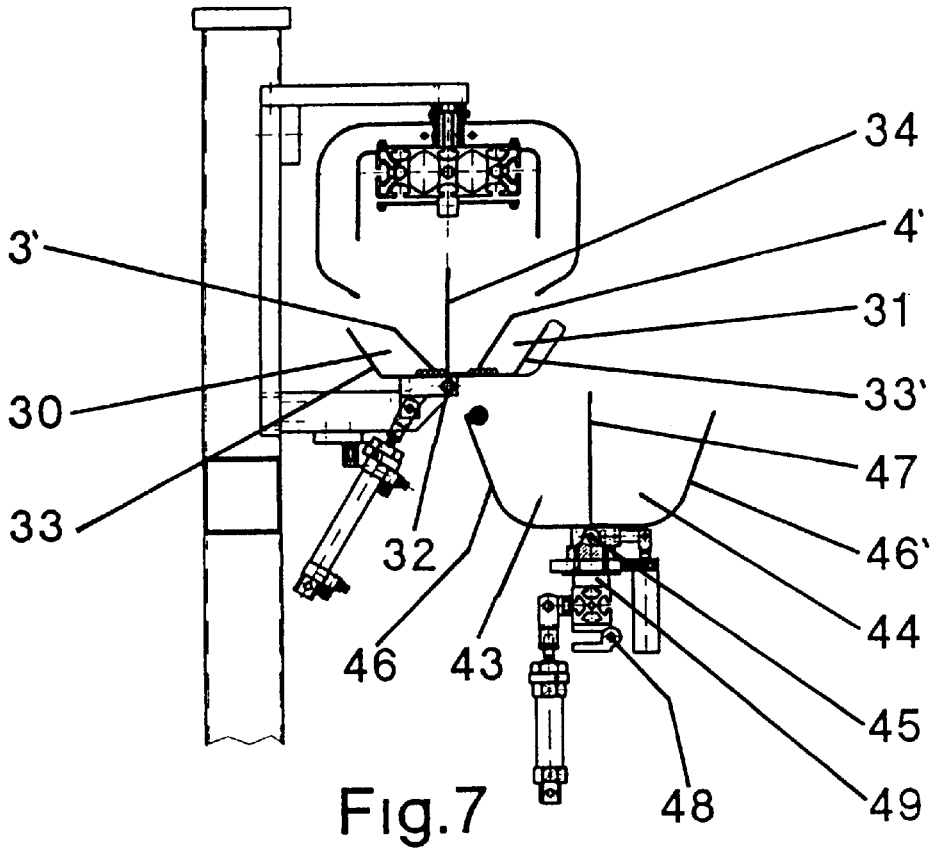
FIGS. 7 to 12 are sequential end views of a preferred embodiment of the depositing device according to the present invention.
Figure 8:
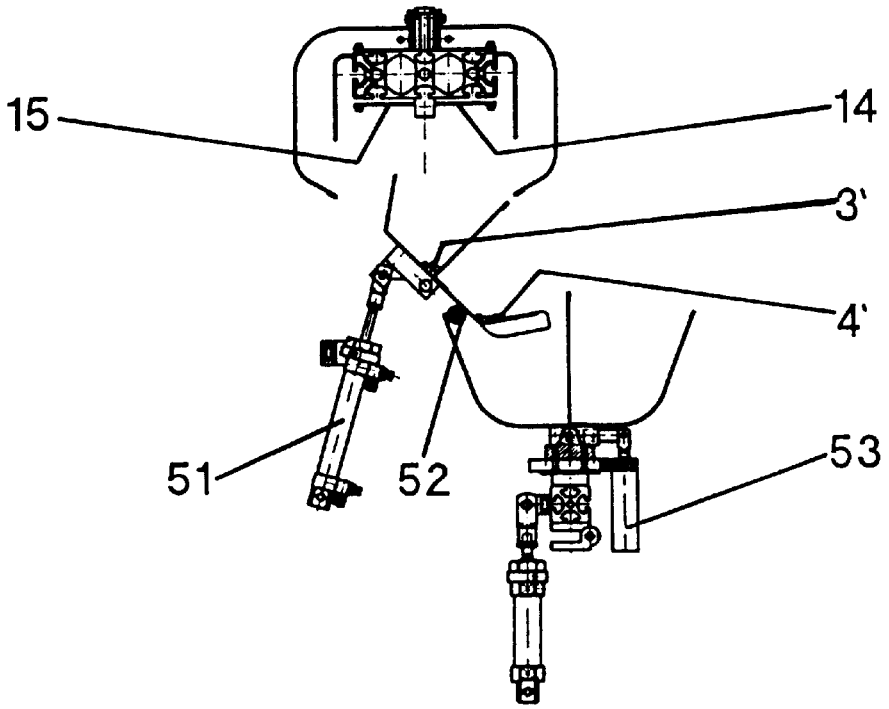

The ejection of the second cable 3 beyond the ejection longitudinal side 29 into the deposition trough 30 located therebelow can be effected either by similarly swivelling the swivel arm 22 out in the opposite direction B (see FIG. 2) or by means of a swivelling lever 39 (see FIG. 7) which is driven by a drive motor 38 and capable of by 180° rotation.

Figure 5:
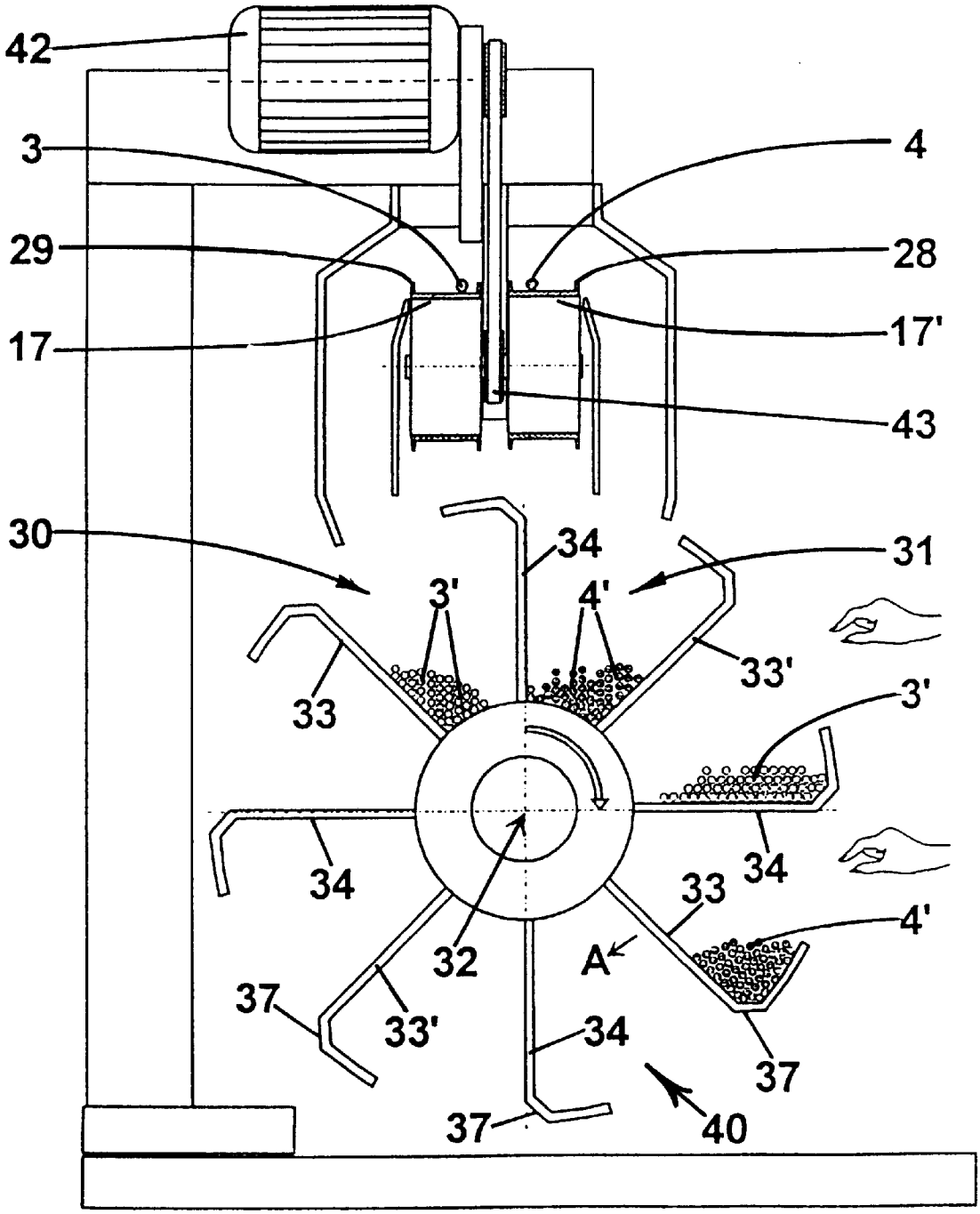
FIG. 5 is a cross-section through the drive of a second embodiment of a cable depositing device according to the present invention having two cable deposition transport bands running parallel to one another.
Figure 6:
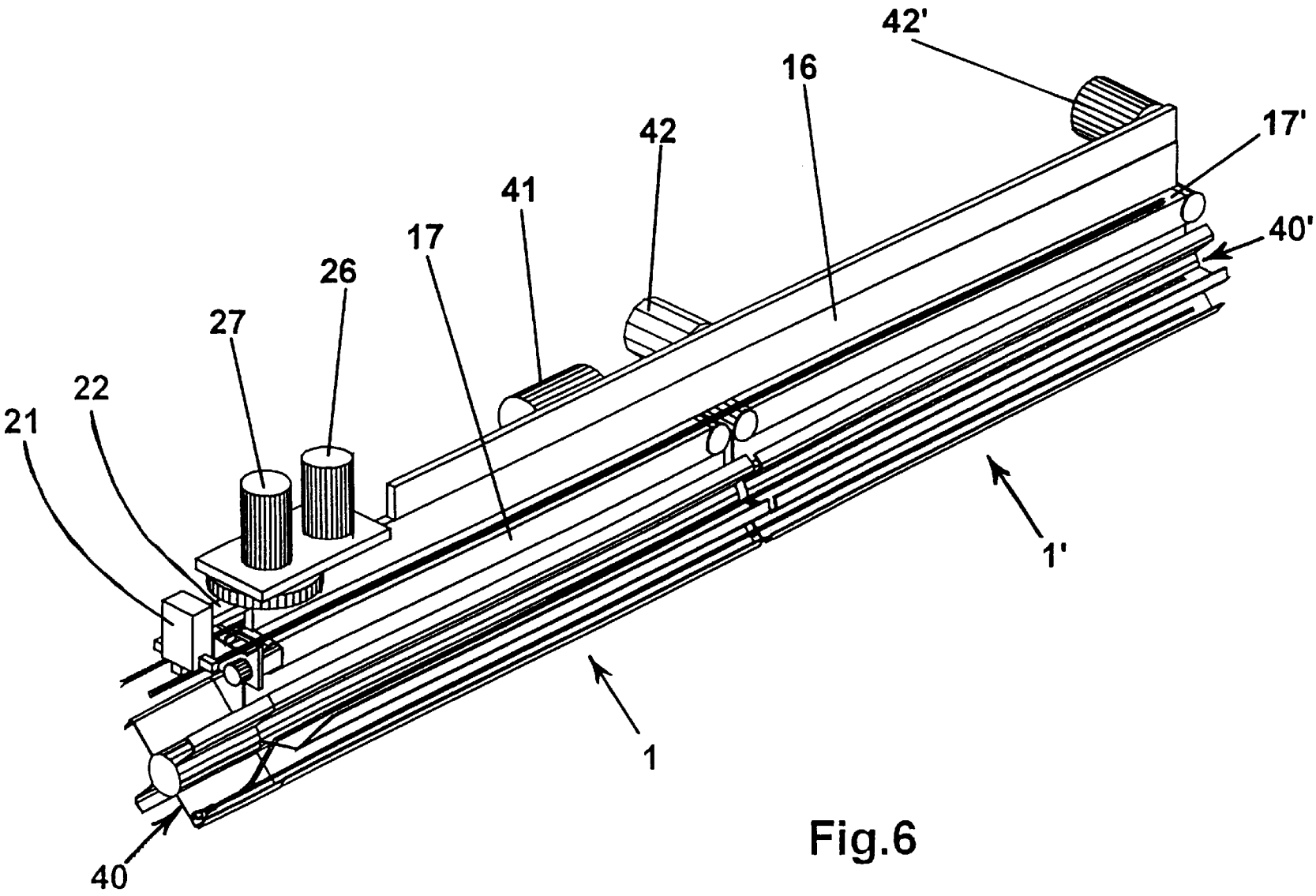
FIG. 6 is a perspective view similar to FIG. 2, but having an extension piece for use with of longer cables.

For the purpose of processing extremely long cables, with the cable depositing device of a similarly constructed additional extension unit 1', as may be seen from FIG. 6 is provided. The rear end face of the double trough rotor 40 must be free for coupling with a similar extension rotor. That is to say the rotor drive motor 42 must be arranged, for example, as is to be seen from FIG. 5, and in order not to prevent lateral ejection of the cable 3 beyond the ejection longitudinal side 29 extended in such a way. In this case, the front edges 35,36 and 36', at the entry end, can all lie in a single radial plane in the case of the extension piece 1', since the boundary walls 33,33' and 34 of the extension piece or of the double trough rotor 40' serve only to extend the corresponding boundary walls of the front double trough rotor 40 in the axial direction thereof.

Of course, given the use of appropriate processing units, it is also possible to use the cable depositing device provided to provided another two completely mutually separated individual cables with crimp contacts on both sides, that are parallel to one another and to deposit them separate from one another in the assigned deposition troughs 30 and 31.

It would be desirable if the removal of the processed cables or double cables could be performed substantially remote from moving parts of the cable depositing device and, in the interests of greater clarity, if this could be done more from above.

A subject-matter of the present invention is therefore also a development of the cable depositing device described above, which permits the processed cables or double cables to be removed further away from moving parts of the cable depositing device described there, and in a fashion more from above.

As is to be seen by FIGS. 7 to 13, a cable depositing device in accordance with a preferred embodiment of present invention has, instead of the pairs 30,31 of cable deposition troughs arranged like a paddle wheel, as described above, a single pair 30,31 of cable deposition troughs that are which is arranged in a manner capable of swivelling about a swivel axis 32 extending parallel to the two receiving and stretching regions 14,15. The deposition troughs 30, 31 are also capable of being emptied downwards into a lower pair 43,44 of cable removal troughs running parallel thereto. The upper pair 30,31 of cable deposition troughs has boundary walls 33,33' and 34 extending along the swivel axis 32. The lower pair 43,44 of cable removal troughs can be swivelled from a cable receiving position (FIG. 9) into a laterally offset removing position (FIG. 11) about a further swivel axis 45, which runs parallel to the swivel axis 32 of the upper pair 30,31 of cable deposition troughs and is laterally offset with respect to the said swivel axis 32, seen in the plan view. The pair of cable removal troughs 30, 31 have boundary walls 46,46' and 47 extending along the further swivel axis 45.

The middle boundary wall 34 of the upper pair 30,31 of cable deposition troughs forms a common partition between the two mutually neighbouring cable deposition troughs 30,31 of the pair 30,31 of cable deposition troughs, and the middle boundary wall 47 of the lower pair 43,44 of cable removal troughs forms a common partition between the two mutually neighbouring cable removal troughs 43,44 of the lower pair 43,44 of cable removal troughs.

In a fashion similar to the exemplary embodiments previously described, the front edge 35, at the entry end of the middle partition 34 of the upper pair 30,31 of cable deposition troughs, is set back with respect to the two front edges 36,36' at the entry end of the two outer boundary walls 33,33' of the upper pair 30,31 of cable deposition troughs. Seen in the plan view of the device and in the direction A of movement of cables 3,4 conveyed out of the automatic cable machine 2, the front edges 36,36', at the entry end of the respective two outer boundary walls 33,33' of the upper pair 30,31 of cable deposition troughs are located upstream of the delivery point of the cable gripping parts 21 provided on the swivel arm 22. (See FIG. 6).

Figure 9:
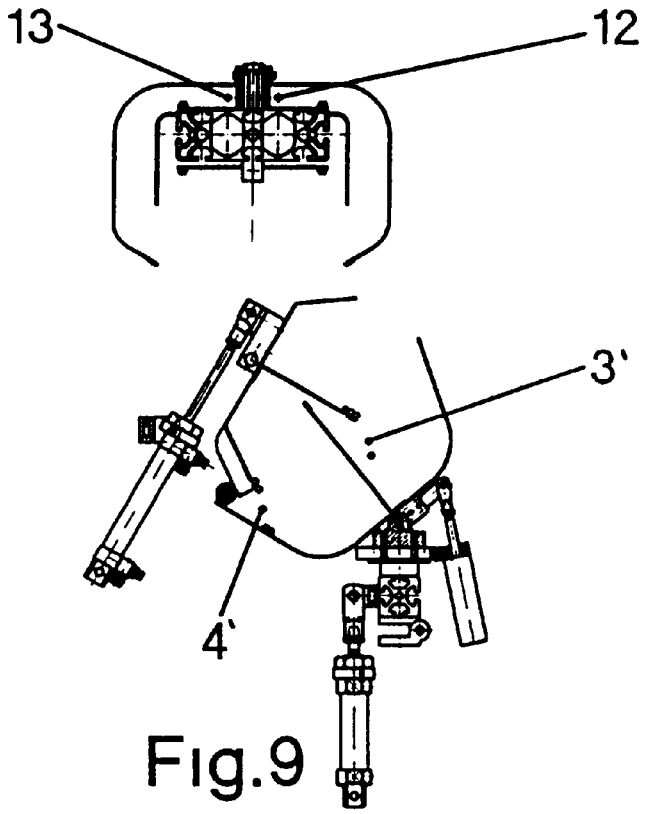

The boundary walls 33,33' and 46,46' and the two partitions 34 and 47 as well as the swivelling ranges of the two pairs 30,31 and 43,44 of troughs are adapted to one another in such a way that in the case of swivelling of the upper pair 30,31 of cable deposition troughs by means of a pneumatic or hydraulic linear cylinder 51 into its emptying position, as seen in FIG. 9, the partition 34 of the upper pair 30,31 of troughs is moved as far as into the interior of one assigned lower cable removal trough 44, and the boundary wall 33', which is located below in the emptying position of the upper pair 30,31 of troughs, of this pair 30,31 of troughs is moved as far into the interior of the other assigned lower cable removal trough 43, in order to permit an undisturbed separated transfer of the processed cables 3',4' into the lower pair 43,44 of cable removal troughs. In this case, the outer side of the trough 31 engages, via one or more rollers 52 arranged on the upper longitudinal edge of the boundary wall 46' (see FIGS. 8 and 9), with the lower pair 43,44 of troughs, bears against and swivels the said pair to the left into its receiving position against the action of a pneumatic spring 53. For the purpose of being swivelled to the left towards the upper pair 30,31 of cable deposition troughs, the lower pair 43,44 of cable removal troughs can be swivelled about a first further swivel axis 45.

Figure 10:
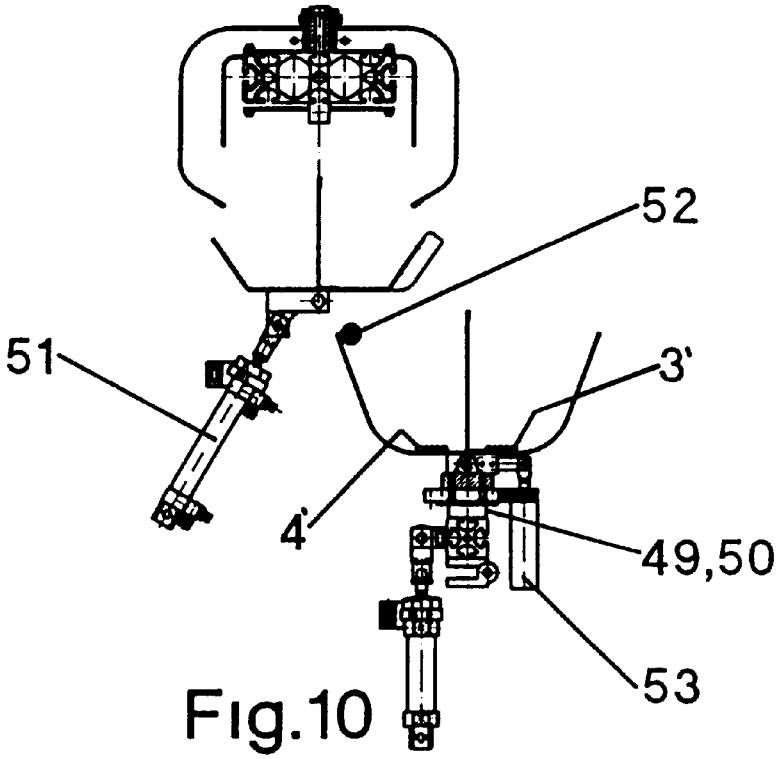
Figure 11:
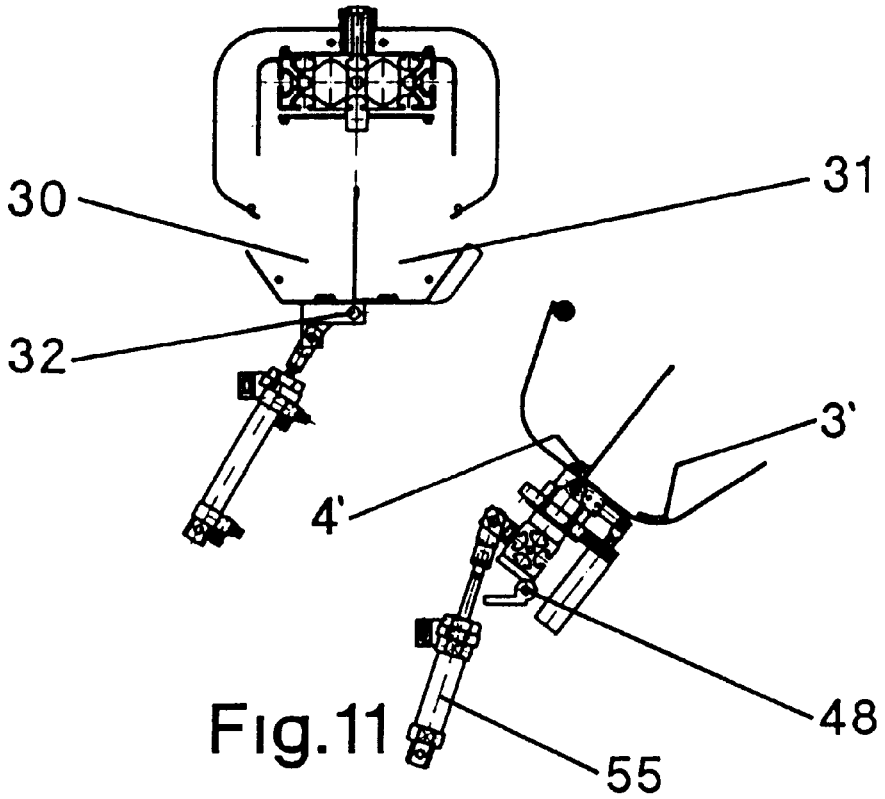

After the processed double crimp cables 3',4' have been delivered from the upper pair 30,31 of troughs into the lower pair 43,44 of troughs, the upper pair 30,31 of troughs is moved back again counter clockwise into its initial position by means of the linear cylinder 51, and in so doing releases the lower pair 43,44 of troughs, which, under the influence of the pneumatic spring 53, also returns into its initial position, as seen in FIG. 10.

Figure 13:
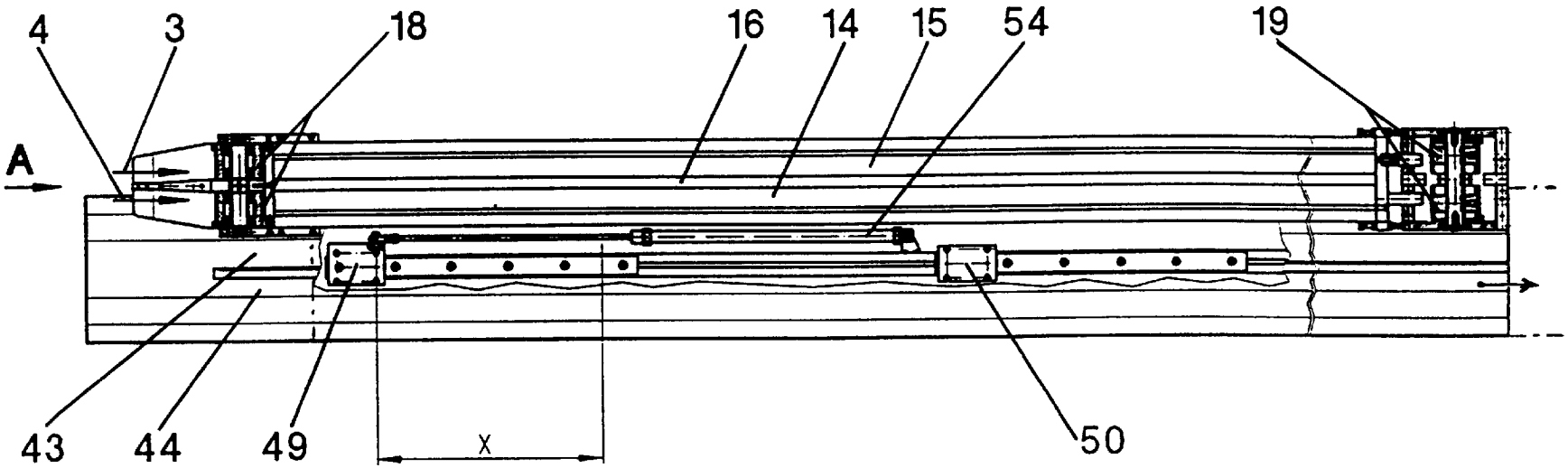
FIG. 13 shows, on a smaller scale, a plan view of the depositing device shown in FIG. 7.

Referring to FIG. 13, since the left-hand end part of the cable depositing device 1 is located, as may be seen from FIG. 1, in the region of the automatic cable processing machine 2, the left-hand end part of the lower pair 43,44 of cable removal troughs is not very easily accessible for removing processed pairs 3',4' of cables. The lower pair 43,44 of cable removal troughs is displaced with the aid of a linear cylinder 54, along a two-part longitudinal guide 49,50, which runs parallel to the swivel axis 32 of the upper pair 30,31 of cable deposition troughs and is laterally offset with respect to this swivel axis 32, seen in plan view (FIG. 13), to the right, in the direction A from a cable receiving position into an end position which is offset to the right in the longitudinal direction in FIG. 13 by an amount of, for example, 500 mm.

In this end position of the longitudinal displacement of the lower pair 43,44 of troughs, in order to achieve as much swivelling out of the lower pair 43, 44, (to the right, in FIG. 11) by means of a pneumatic or hydraulic linear cylinder 55 into a cable removing position, while preserving good accessibility of the lower pair 43,44 of troughs or of the pairs 3',4' of cables located therein, from above, for the purpose of forming a larger swivelling radius, the lower pair 43,44 of cable removal troughs can be swivelled outwards about a second further swivel axis 48 provided below the first further swivel axis 45.

Figure 12:
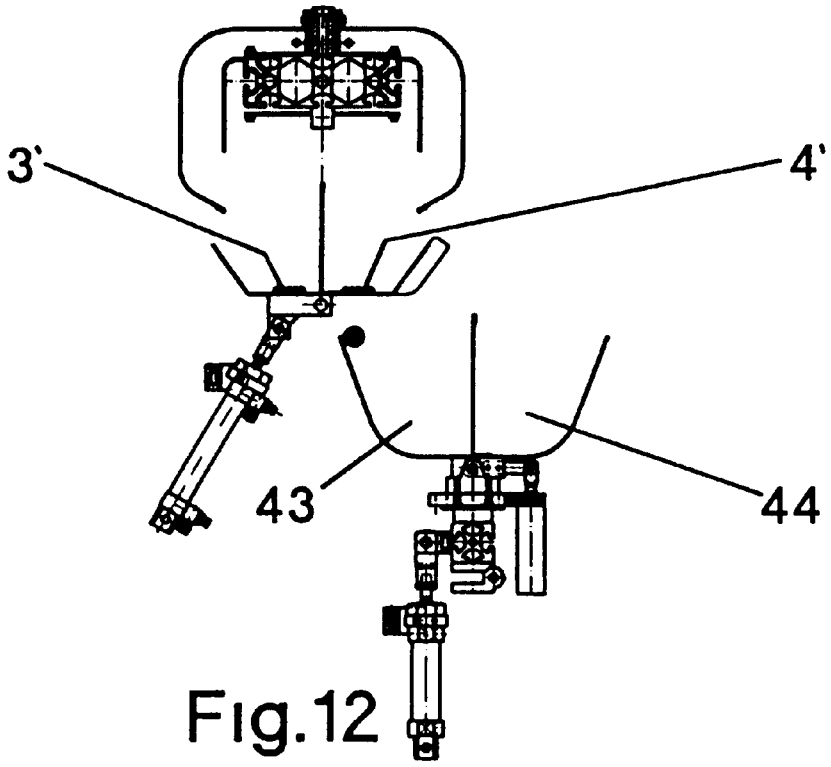

After the removal of the processed pairs 3',4' of cables from the lower pair 43,44 of troughs, the are swivelled back again by means of the linear cylinder 54 into their erect position as can be seen in FIG. 12, and thereafter moved back in the longitudinal direction of the two-part longitudinal guide 49,50 into their initial position, as can be seen in FIG. 13. After which, the entire operating cycle described above in FIGS. 7 to 13 is repeated.

What is claimed is:

1. A cable depositing device for processing a plurality of cables, said device comprising:

(a) at least one receiving transport band for transporting processed cables having a length and an entry end, said receiving transport band defining a cable entry region and comprising an upper driving strand, (b) a partition that extends above said upper driving strand of said receiving transport band along said length of said receiving transport band, said upper driving strand of said receiving transport band and said partition defining two receiving and stretching regions on either side of said partition, and (c) a swivel arm disposed in said cable entry region, said swivel arm defining a swivelling-out range and comprising means for gripping and feeding said cables toward said entry end.

2. The device of claim 1 further comprising at least one cable processing station located in said swivelling-out range defined by said swivel arm, wherein said swivel arm is adapted to feed at least one of said plurality of cables to said at least one cable processing station.

3. The device of claim 1 further comprising a pair of cable deposition troughs that are spaced below said two receiving and stretching regions.

4. The device of claim 3 wherein said device has a first swivel axis extending parallel to said two receiving and stretching regions, said pair of cable deposition troughs is defined by two outer boundary walls and a middle boundary wall extending along said first swivel axis, and said pair of cable deposition troughs swivel about said first swivel axis.

5. The device of claim 4 further comprising a pair of cable removal troughs spaced below and parallel to said pair of cable deposition troughs, said pair of cable removal troughs being defined by two outer boundary walls and a middle boundary wall, wherein said first pair of cable deposition troughs are adapted to be emptied downwards into said pair of cable removal troughs.

6. The device of claim 5 wherein said two outer boundary walls and said middle boundary wall of said pair of cable deposition troughs have front and rear edges, and wherein said front edge of said middle boundary wall is set back with respect to said front edges of said two outer boundary walls.

7. The device of claim 5 wherein said device has a second swivel axis that extends parallel to said first swivel axis, and said pair of cable removal troughs swivels about said second swivel axis from a cable receiving position to a laterally offset removing position.

8. The device of claim 7 wherein said middle boundary wall of said pair of cable deposition troughs is received by one of said cable removal troughs when said pair of said cable deposition troughs is emptied into said pair of cable removal troughs, and one of said outer boundary walls of said pair of cable deposition troughs is received by the other of said pair of cable removal troughs.

9. The device of claim 7 wherein said device has a third swivel axis about which said pair of cable removal troughs swivel.

10. The device of claim 9 wherein said pair of cable deposition troughs has a receiving position and an emptying position.

11. The device of claim 10 wherein one of said two outer boundary walls is in an upper position when said pair of cable deposition troughs is in an emptying position, and one of said outer boundary walls is in a lower position, and the outer boundary wall in the lower position bears against one of said outer boundary walls of said pair of cable removal troughs when said pair of cable deposition troughs is in an emptying position.

12. The device of claim 11 wherein said pair of cable deposition troughs causes said pair of cable removal troughs to swivel about said second swivel axis.

13. The device of claim 11 wherein the middle boundary wall of the pair of cable deposition troughs bears against said middle boundary wall of said pair of cable removal troughs when said pair of cable deposition troughs is in said emptying position.

14. The device of claim 5 wherein said pair of cable removal troughs is adapted to be longitudinally displaced parallel to said first swivel axis from a cable receiving position to a removing position.

15. The device of claim 5, wherein said means for gripping said cables of said swivel arm has a delivery point, and wherein said front edges of said outer boundary walls of said pair of cable deposition troughs are located between said entry end and said delivery point.

16. The device of claim 1 further comprising at said entry end of said receiving and stretching region, beyond an angular extent of said swivelling-out range defined by said swivel arm, a cable ejecting arrangement which is adapted to be moved laterally outwards beyond said receiving and stretching region.

17. A cable depositing device for processing a plurality of cables and for coupling to an automatic cable processing machine having a swivel arm in a cable exit region, said device comprising:

(a) at least one receiving transport band for transporting processed cables having a length and an entry end, said receiving transport band defining a cable entry region and comprising an upper driving strand, (b) a partition that extends above said upper driving strand of said receiving transport band along said length of said receiving transport band, said upper driving strand of said receiving transport band and said partition defining two receiving and stretching regions on either side of said partition, and (c) said swivel arm disposed in said cable entry region, said swivel arm defining a swivelling-out range and comprising means for gripping and feeding said cables toward said cable entry region.

18. The device of claim 17 further comprising at least one cable processing station located in said swivelling-out range defined by said swivel arm, wherein said swivel arm is adapted to feed at least one of said plurality of cables to said at least one cable processing station.

19. The device of claim 17 further comprising a pair of cable deposition troughs that are spaced below said two receiving and stretching regions.

20. The device of claim 19 wherein said device has a first swivel axis extending parallel to said two receiving and stretching regions, said pair of cable deposition troughs is defined by two outer boundary walls and a middle boundary wall extending along said first swivel axis, and said pair of cable deposition troughs swivel about said first swivel axis.

21. The device of claim 20 further comprising a pair of cable removal troughs spaced below and parallel to said pair of cable deposition troughs, said pair of cable removal troughs being defined by two outer boundary walls and a middle boundary wall, wherein said first pair of cable deposition troughs are adapted to be emptied downwards into said pair of cable removal troughs.

22. The device of claim 21 wherein said two outer boundary walls and said middle boundary wall of said pair of cable deposition troughs have front and rear edges, and wherein said front edge of said middle boundary wall is set back with respect to said front edges of said two outer boundary walls.

23. The device of claim 21 wherein said device has a second swivel axis that extends parallel to said first swivel axis, and said pair of cable removal troughs swivels about said second swivel axis from a cable receiving position to a laterally offset removing position.

24. The device of claim 23 wherein said middle boundary wall of said pair of cable deposition troughs is received by one of said cable removal troughs when said pair of said cable deposition troughs is emptied into said pair of cable removal troughs, and one of said outer boundary walls of said pair of cable deposition troughs is received by the other of said pair of cable removal troughs.

25. The device of claim 23 wherein said device has a third swivel axis about which said pair of cable removal troughs swivel.

26. The device of claim 25 wherein said pair of cable deposition troughs has a receiving position and an emptying position.

27. The device of claim 26 wherein one of said two outer boundary walls is in an upper position when said pair of cable deposition troughs is in an emptying position, and one of said outer boundary walls is in a lower position, and the outer boundary wall in the lower position bears against one of said outer boundary walls of said pair of cable removal troughs when said pair of cable deposition troughs is in an emptying position.

28. The device of claim 27 wherein said pair of cable deposition troughs causes said pair of cable removal troughs to swivel about said second swivel axis.

29. The device of claim 27 wherein the middle boundary wall of the pair of cable deposition troughs bears against said middle boundary wall of said pair of cable removal troughs when said pair of cable deposition troughs is in said emptying position.

30. The device of claim 21 wherein said pair of cable removal troughs is adapted to be longitudinally displaced parallel to said first swivel axis from a cable receiving position to a removing position.

31. The device of claim 21 wherein said means for gripping said cables of said swivel arm has a delivery point, and wherein said front edges of said outer boundary walls of said pair of cable deposition troughs are located between said entry end and said delivery point.

32. The device of claim 17 further comprising at said entry end of said receiving and stretching region, beyond an angular extent of said swivelling-out range defined by said swivel arm, a cable ejecting arrangement which is adapted to be moved laterally outwards beyond said receiving and stretching region.

33. A method of processing a pair of cables using a cable depositing device that includes at least one receiving transport band having a length and an entry end, said receiving transport band for transporting processed cables defining a cable entry region and comprising an upper driving strand, a partition that extends above said upper driving strand of said receiving transport band along said length of said receiving transport band, said upper driving strand of said receiving transport band and said partition defining two receiving and stretching regions on either side of said partition, a swivel arm disposed in said cable entry region, said swivel arm defining a swivelling-out range and comprising means for gripping said cables and a pair of cable deposition troughs that are spaced below said two receiving and stretching regions, said method comprising the steps of:

(a) disposing said pair of cables on said upper driving strand of said receiving transport band, wherein each cable of said pair is disposed in one receiving and stretching region, (b) gripping at least one of said pair of said cables with said means for gripping said cables, (c) swivelling said swivel arm, and (d) depositing said pair of cables in said cable deposition troughs.

* * * * *